US009951523B1

(12) United States Patent
Collins et al.

(10) Patent No.: US 9,951,523 B1
(45) Date of Patent: Apr. 24, 2018

(54) ROOF ASSEMBLIES

(71) Applicant: Solarcraft, Inc., Sugar Land, TX (US)

(72) Inventors: Robert Francis Collins, Sugar Land, TX (US); Victor Francis Gingles, Sugar Land, TX (US)

(73) Assignee: Solarcraft, Inc., Sugar Land, TX (US)

( * ) Notice: Subject to any disclaimer, the term of this patent is extended or adjusted under 35 U.S.C. 154(b) by 0 days.

(21) Appl. No.: 15/653,211

(22) Filed: Jul. 18, 2017

(51) Int. Cl.
*E04B 7/02* (2006.01)
*E04D 3/35* (2006.01)
*E04D 1/34* (2006.01)
*E04D 3/36* (2006.01)

(52) U.S. Cl.
CPC ..... *E04D 3/35* (2013.01); *E04D 1/3402* (2013.01); *E04D 1/3405* (2013.01); *E04D 3/3603* (2013.01)

(58) Field of Classification Search
CPC ..... E04D 3/35; E04D 3/3603; E04D 1/3405; E04D 1/3402; E04D 2001/3461; E04D 1/305; E04D 2001/3432; E04B 7/06; E04B 2001/2412; E04B 2001/2457
USPC ..... 52/90.1
See application file for complete search history.

(56) References Cited

U.S. PATENT DOCUMENTS 1,068,319 A 7/1913 Christy
3,073,235 A * 1/1963 Randall ..... E04D 13/152 248/223.41
3,127,960 A * 4/1964 Smith ..... E04C 2/08 52/222
4,400,924 A 8/1983 Andrews
4,420,913 A * 12/1983 Long ..... E04D 3/30 52/54
6,581,337 B1 6/2003 Skov et al.
7,395,634 B2 7/2008 Anderson et al.
8,925,255 B1 1/2015 Haun et al.
2001/0017011 A1* 8/2001 Richardson ..... E04D 3/08 52/90.1
2002/0046510 A1* 4/2002 Whiting ..... E04B 7/063 52/90.1
2003/0024175 A1* 2/2003 Jones ..... E04B 7/063 52/90.1
2004/0144040 A1* 7/2004 Fulford ..... E04D 13/174 52/57
2006/0048461 A1* 3/2006 Jones ..... E04B 7/063 52/90.1
2008/0053004 A1* 3/2008 Oberoi ..... E04D 1/30 52/43

* cited by examiner

*Primary Examiner* — Patrick J Maestri
(74) *Attorney, Agent, or Firm* — The Elliott Law Firm, PLLC; Douglas H. Elliott; Nathan Q. Huynh

(57) ABSTRACT

One or more specific versions disclosed herein includes a method for assembling a roof including: covering a first portion of a roof ridge with a first ridge cap having a first groove disposed therein; covering a second portion of the roof ridge with a second ridge cap having a second groove disposed therein, wherein the first groove and the second groove are combined to form a third groove; and sliding a rafter cover having a finger with a beveled edge along a rafter in the direction of the ridge caps, wherein the beveled edge passes through the third groove.

17 Claims, 8 Drawing Sheets

ROOF ASSEMBLIES

BACKGROUND

1. Field of Inventions

The field of this application and any resulting patent relates to roof assemblies.

2. Description of Related Art

Roofing work can be dangerous even under the best conditions. High elevations, unprotected roof edges and steep slopes all pose fall risks. Those risks may be increased by other factors, such as wind, cold temperature, and wet surfaces. The risk and assembly times are further enlarged when a worker needs to periodically connect parts of a roof together using a tool such as a hammer or screw driver in combination with metal objects such as screws, bolts or rivets. Therefore, a need exists for a roof that can be assembled quickly and easily so as to avoid or reduce the problems mentioned above.

Various roof structures and methods for assembling roof assemblies have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes a method for assembling a roof including: covering a first portion of a roof ridge with a first ridge cap having a first groove disposed therein; covering a second portion of the roof ridge with a second ridge cap having a second groove disposed therein, wherein the first groove and the second groove may be combined to form a third groove; and sliding a rafter cover having a finger with a beveled edge along a rafter in the direction of the ridge caps, wherein the beveled edge may pass through the third groove.

The disclosure herein includes a method for assembling a roof including: covering a first portion of a roof ridge and a portion of a first flange with a first ridge cap having a first P-shaped groove disposed therein; covering a second portion of the roof ridge and a portion of a second flange with a second ridge cap having a second P-shaped groove disposed therein, wherein the first P-shaped groove may be combined with the second P-shaped groove to form a first T-shaped groove; and sliding a rafter cover having a finger with a beveled edge along the first flange and the second flange in the direction of the ridge cap, where in the beveled edge may pass through the first T-shaped groove.

The disclosure herein includes a method for assembling a roof including: providing a ridge cap assembly having a T-shaped groove; providing a rafter cover having a finger with a beveled edge; and sliding the rafter cover along a rafter in the direction of the ridge cap assembly, wherein the beveled edge may pass through the T-shaped groove.

DETAILED DESCRIPTION

1. Introduction

Figure 1A:
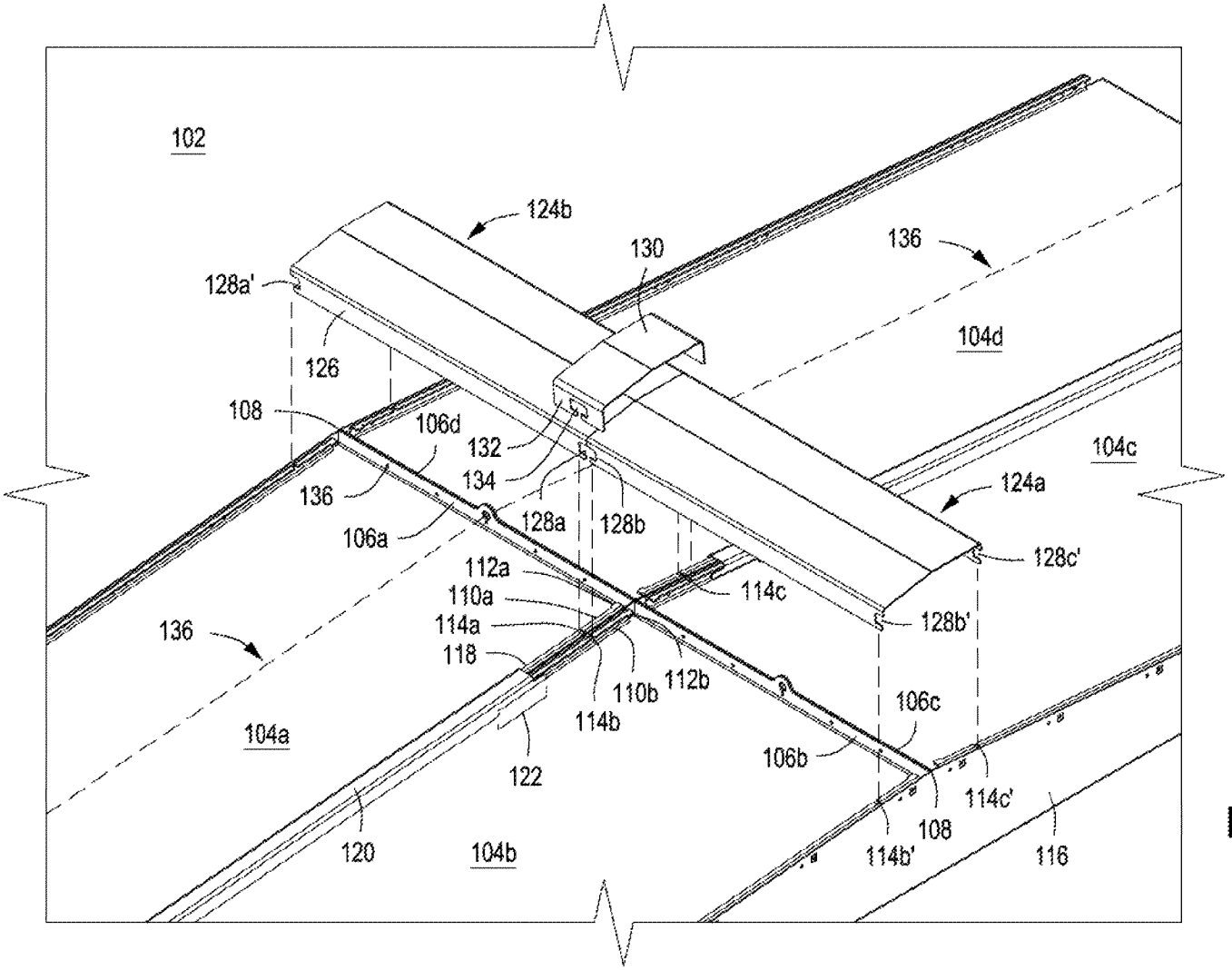
FIG. 1A shows an exploded view of a roof assembly.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments of the inventions (e.g., versions and/or examples), but the inventions are not limited to these specific embodiments, which are included to enable a person having ordinary skill in the art to make and use the inventions when the information in this patent is combined with available information and technology.

Various terms as used herein are defined below, and the definitions should be adopted when construing the claims that include those terms, except to the extent a different definition is given elsewhere within the specification or in express representations to the Patent and Trademark Office (PTO). To the extent a term used in a claim is not defined in this detailed description or in any representation to the PTO, that term should be given the broadest definition persons having skill in the art have given that term as reflected in at least one printed publication, dictionary, published patent application, or issued patent.

2. Selected Definitions

Certain claims include one or more of the following terms which, as used herein, are expressly defined below.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. For example, when a T-shaped groove of one structure is aligned with two combined P-shaped grooves of other structures, as exemplified in certain assemblies disclosed herein, an object (e.g. a rafter cover finger) may be capable of extending across or through both the T-shaped groove and the combined P-shaped grooves.

The term "covering" as used herein is a verb that means positioning any structure or surface over another structure or surface, preferably to shield the other structure or surface. After any covering takes place the latter structure or surface may be fully or partially "covered" by the former structure or surface. Covering may be complete or partial. Preferably covering includes making physical contact between the covering structures or surface and the covered structure or surface. However, in some cases, the covering structure does not necessarily have to be in contact with what is being covered. For example, a ridge cap may be used for covering a roof ridge or flange of a roof panel. Another example may be a rafter cover used for covering a rafter.

Figure 2C:
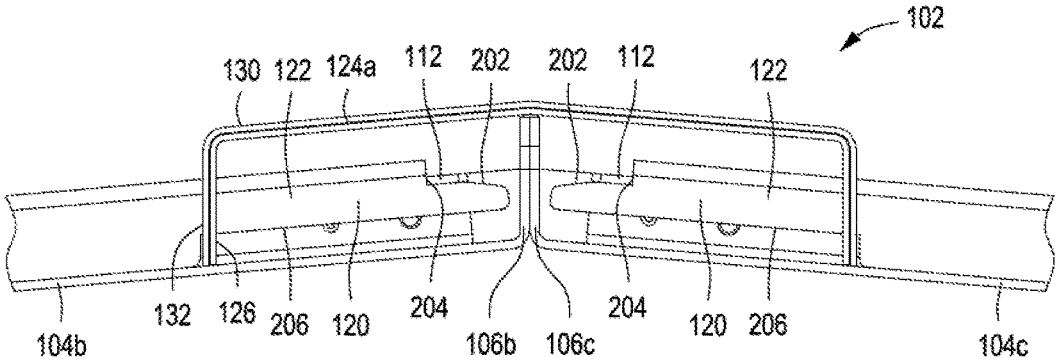
FIG. 2C shows a side view of a finger of a rafter cover having been slid through the ridge cap and the ridge cap cover.
Figure 3:
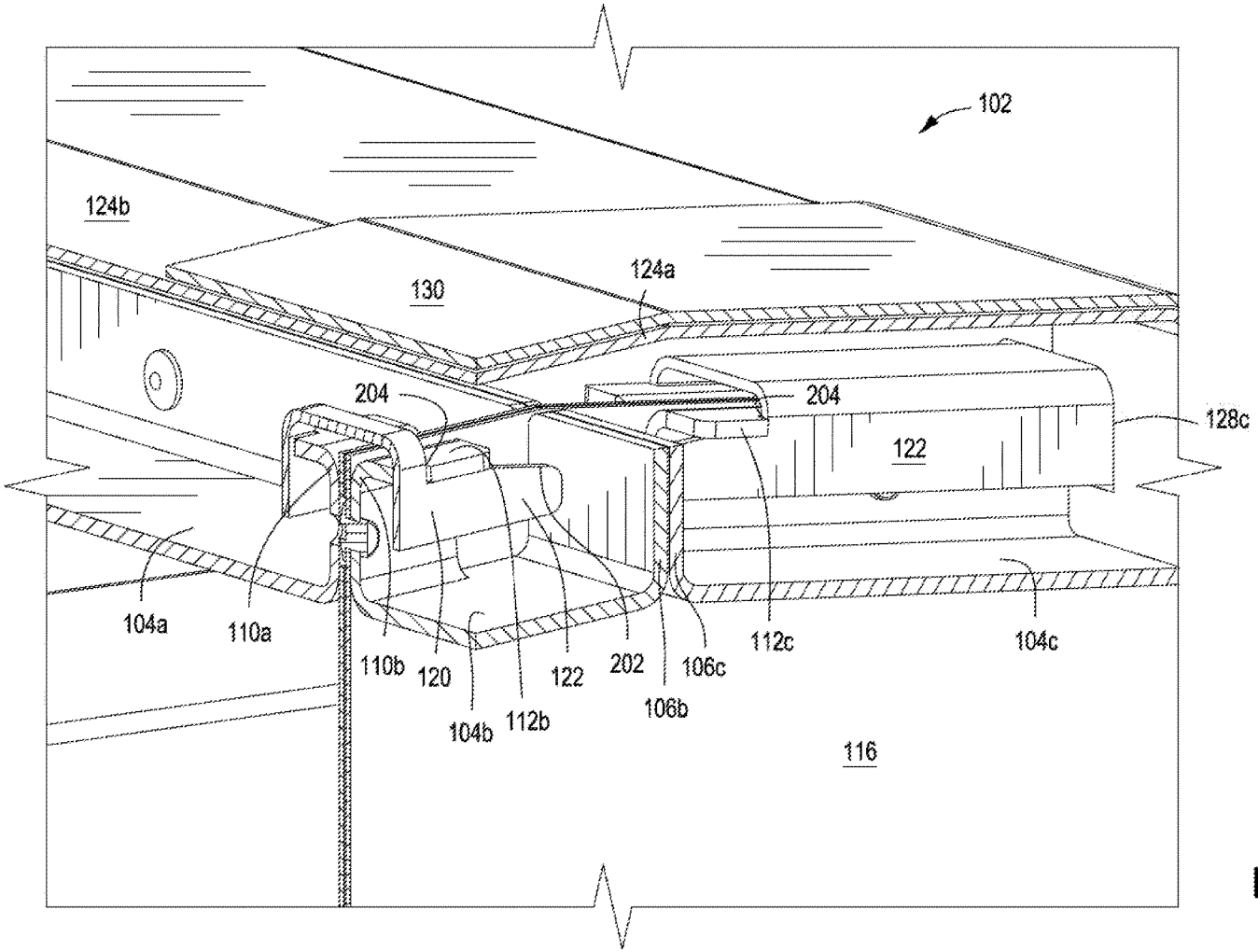
FIG. 3 shows a cross-sectional view under the ridge cap of assembled FIG. 1A.

The term "finger" as used herein means a protrusion, e.g., a protruding end of a rafter cover. Preferably, a finger includes a beveled edge, an upper shoulder, and a lower shoulder. An example of a finger is depicted in FIG. 2C and FIG. 3, which show an upper shoulder 204 that includes at least two upper shoulder portions, each one forming an angle in relation to the other, preferably ninety (90) degrees. Thus, a first portion (part or section) of the upper shoulder may have an edge that is preferably perpendicular to the edge of a second portion (part or section) that extends towards the end of the rafter cover. As exemplified in FIG. 3, before reaching the end of the rafter cover, the second portion of the upper shoulder ends, and a beveled edge begins. The beveled edge is preferably part of the same overall structure as the upper and lower shoulders, but may be considered a separate element for purposes herein. As exemplified in FIG. 3, the beveled edge preferably slopes at a downward angle, less than 90 degrees relative to the second portion of the upper shoulder, and more preferably less than 45 degrees. e.g., between 10 and 35 degrees relative to the edge of the upper shoulder that adjoins the beveled edge. A beveled edge that is part of a finger may terminate at the end of the rafter cover. As shown in FIG. 1A, the finger is preferably integral to (part of) the rafter cover. Advantageously, in certain specific versions, a portion of a finger (e.g., a beveled edge) of a rafter cover may be slid below a tab of a flange, preferably to a position such that the upper shoulder abuts the tab, thereby preventing the finger (and rafter cover) from moving forward further. A portion of a finger (e.g., a beveled edge) may be slid below two tabs of a rafter.

The term "flange" as used herein means a side of a roof panel that has been folded, preferably twice at ninety (90) degrees each time, to create two bends to form a C-shape or D-shape. Preferably, a line bisecting the convex portion of the C-shape or D-shape can be aligned with a center line of the roof panel (see, e.g., 136, FIG. 1C). The flange is preferably integral to (part of) the roof panel, as exemplified in FIG. 3. A flange is preferably formed on each long side of a roof panel. A flange may be formed on one or more long sides of a roof panel.

The term "groove" as used herein describes any opening in or on a structure or surface. A groove may have a narrow portion and a wide portion. A groove may have a shape that resembles the outline of a block-letter capital C, D, O, P, or T, where the convex portion (of letters C, D, O, and P) or the horizontal portion (of letter T) may be square, rectangular, circular, oblong, oval, or elliptical. A groove may be disposed in a ridge cap. A groove may be disposed in a ridge cap cover.

The term "modular" as used herein means any object or structure, such as a roof panel, ridge cap, ridge cap cover, or rafter cover that can be assembled into a larger object or structure, such as a roof or building; and also refers to any larger object or structure, such as a roof or building, that may be an assembly of other smaller objects or structures, such as modular roof panels or ridge caps or ridge cap covers or rafter covers. Thus, for example, a modular roof may be constructed of modular roof assemblies; and a modular roof assembly may be constructed of modular roof panels.

The term "mounting" as used herein means setting or attaching any structure or surface on another structure or surface. After any mounting takes place, the structure or surface may be fully or partially "mounted." Preferably, mounting includes making physical contact between the mounting structures or surface and the mounted structure or surface.

The term "notch" as used herein means a space disposed in a flange, preferably in the second fold of the flange. A notch may be formed on each flange (side) of a rafter. A notch may slidably receive a lip of a ridge cap. A notch may slidably receive a lip of a ridge cap and a lip of a ridge cap cover. A notch may slidably receive a portion of a ridge cap assembly.

The term "profile" as used herein means an outline, border, or outer perimeter of a structure or surface of a structure.

The term "P-shaped" as used herein describes any shape having a narrow portion and a wide portion, preferably a shape that resembles the outline of a block-letter capital P. The narrow portion is preferably straight and the wide portion is preferably convex, and the wide portion may be square, rectangdular, circular, oblong, oval, or elliptical. A P-shaped groove may be a groove (opening) in or on a structure or surface that is P-shaped. An example of a P-shaped groove is shown in FIG. 1A, in which two P-shaped grooves are combined, back-to-back, forming a T-shaped groove.

The term "rafter" as used herein means a structure formed from two flanges, preferable by joining two roof panels along their long sides. A rafter preferably has two flanges that may be coupled by fasteners (e.g., rivets, screws, and nuts bolts).

The term "rafter cover" as used herein means a structure capable of covering a rafter. At least one version of a rafter cover is a structure with two sides that have been folded, preferably at ninety (90) degrees, to create two bends to form a C-shape or a D-shape. A rafter cover may be bisected at the convex portion of its C-shape or D-shape into substantially equal halves.

The term "ridge cap cover" as used herein means a structure capable of covering a ridge cap. At least one version of a ridge cap cover, as exemplified in FIG. 1B, may be a structure with two short sides (e.g., lips) that have been folded down. The ridge cap cover may have a T-shaped groove disposed in each lip, e.g., two P-shaped grooves in combination. A portion of a ridge cap cover may be slid through a notch disposed in a flange. A portion of a ridge cap cover may be slid through notches disposed in a rafter.

The term "ridge cap" as used herein means a structure capable of covering at least a portion of a roof panel and preferably also at least a portion of a rafter cover. At least one version of a ridge cap may be a structure with two sides that have been folded down into lips. A ridge cap may have a P-shaped groove disposed in the end of each lip, as exemplified in FIG. 1C. A portion of a ridge cap may be slid through a notch disposed in a flange. A portion of a ridge cap may be slid through a notch disposed in a rafter. A ridge cap may cover a portion of a flange. A ridge cap may cover a portion of a rafter. A ridge cap may cover a roof ridge. A ridge cap may cover a portion of a roof ridge. A ridge cap may cover a portion of a rafter cover and a portion of a rafter.

The term "ridge cap assembly" as used herein means a structure that includes two ridge caps that may be joined on their short sides and a ridge cap cover that may be mounted on the ridge caps. A ridge cap assembly may have a T-shaped groove disposed therein. A ridge cap assembly may have a T-shaped groove formed when a first T-shape groove disposed in the ridge cap cover is aligned with a second T-shaped groove that is formed by combined P-shaped grooves disposed in ridge caps. A ridge cap assembly may cover a portion of a rafter cover and a portion of a rafter. A portion of a ridge cap assembly may be slid through a notch disposed in a flange. A portion of a ridge cap assembly may be slid through notches disposed in a rafter.

The term "roof panel" as used herein refers to any portion of a roof or roof assembly having at least one flat surface. For example, as depicted in FIG. 1A, a roof assembly may have four roof panels. Other types of panels, not depicted in the drawings, may also be part of a roof assembly.

The term "roof ridge" as used herein means a side of a roof panel that has been folded up to create a bend. The roof ridge is preferably integral to (part of) a roof panel, as exemplified in FIG. 1E. A roof ridge is preferably formed on a short side of a roof panel. A roof ridge may be formed when roof ridges from two roof panels are position to face each other. A roof ridge may be formed when roof ridges from two or more roof panels are positioned to be adjacent to each other.

The term "tab" as used herein refers to a part of a flange, preferably extending therefrom towards the center line of a roof panel. An example of a tab is depicted in FIG. 1E, which shows a projection (see, e.g., 112) that may extend from a flange 110 towards a center line 136 of a roof panel. A tab is preferably integral to (part of) the flange, as shown in FIG. 1F, but may be considered a separate element for purposes herein. A tab may slidably receive, from below, a finger of a rafter cover, and prevent further sliding of the finger once the tab abuts an upper shoulder of the finger.

Figure 1B:
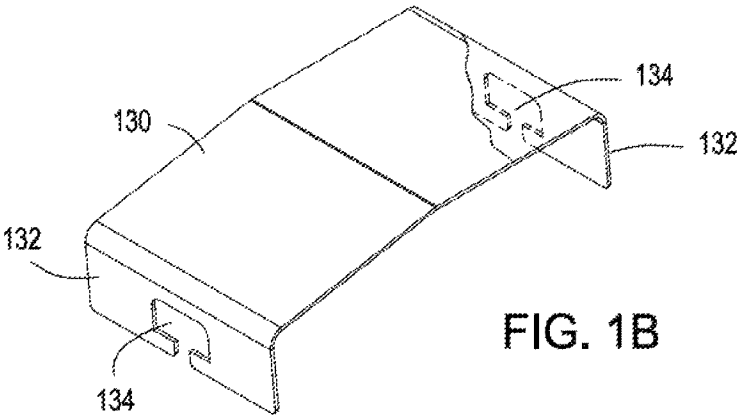
FIG. 1B shows a profile view of a ridge cap cover.
Figure 1C:
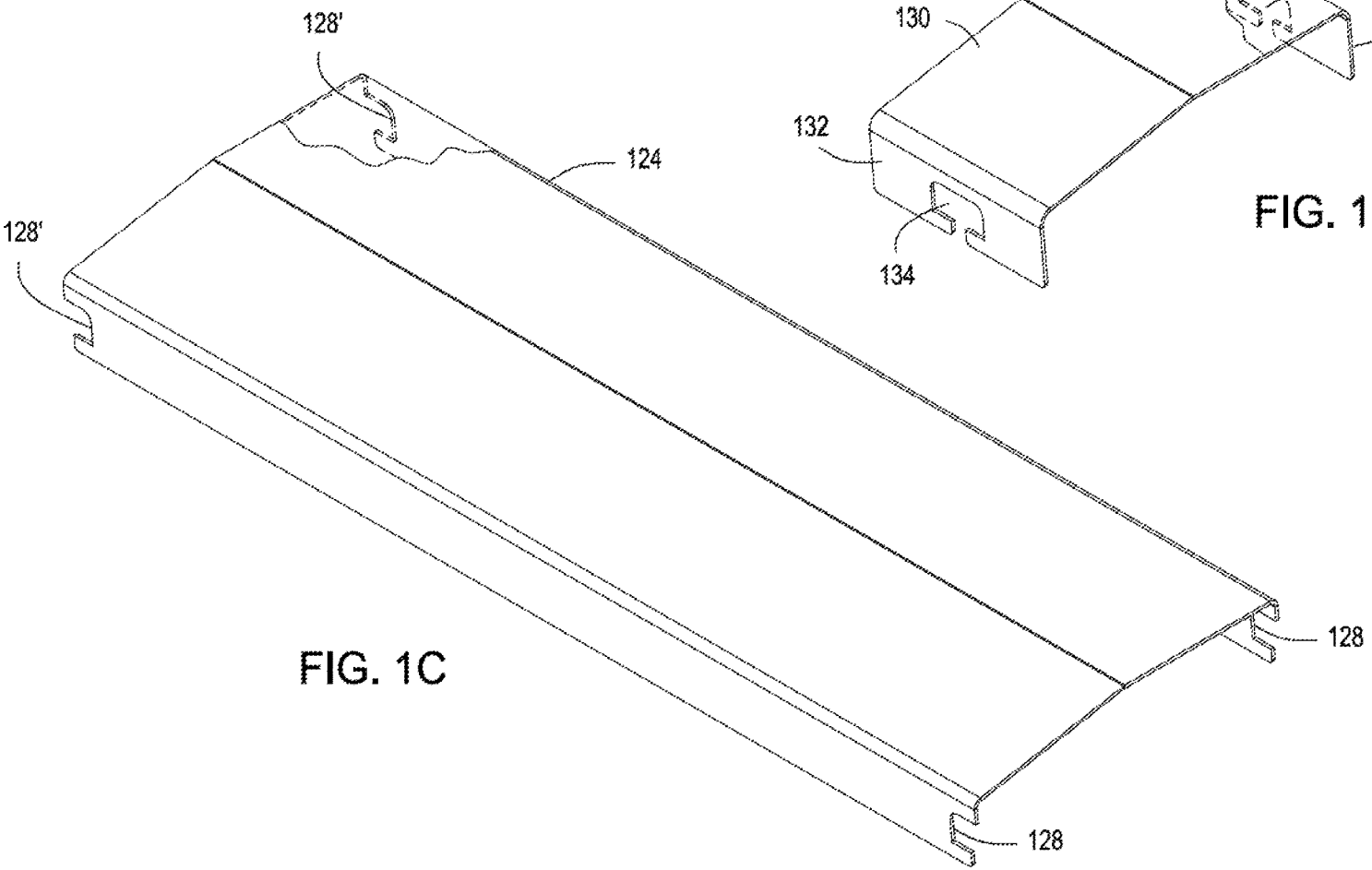
FIG. 1C shows a profile view of a ridge cap.
Figure 1D:
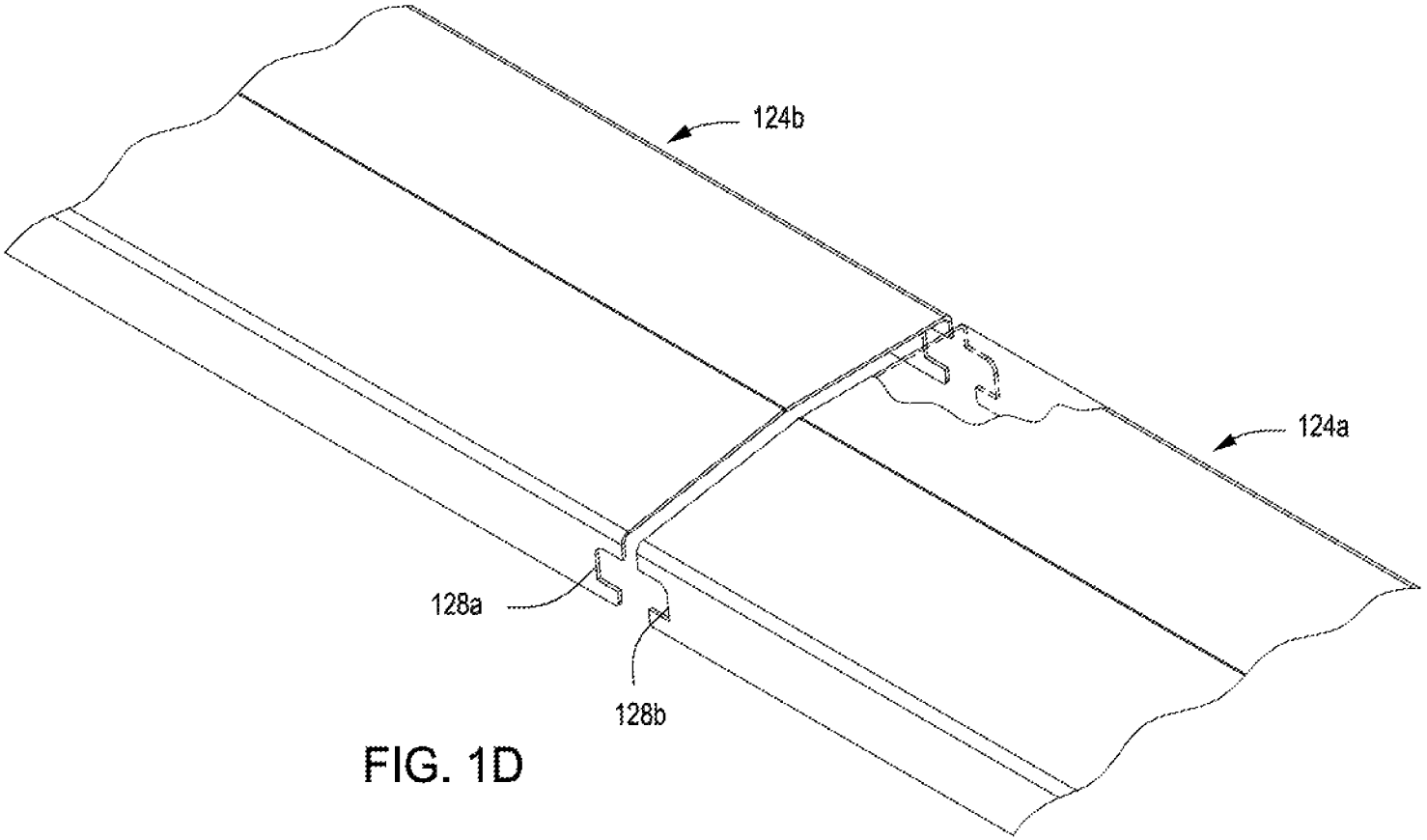
FIG. 1D shows a profile view of two ridge caps being joined together.
Figure 1E:
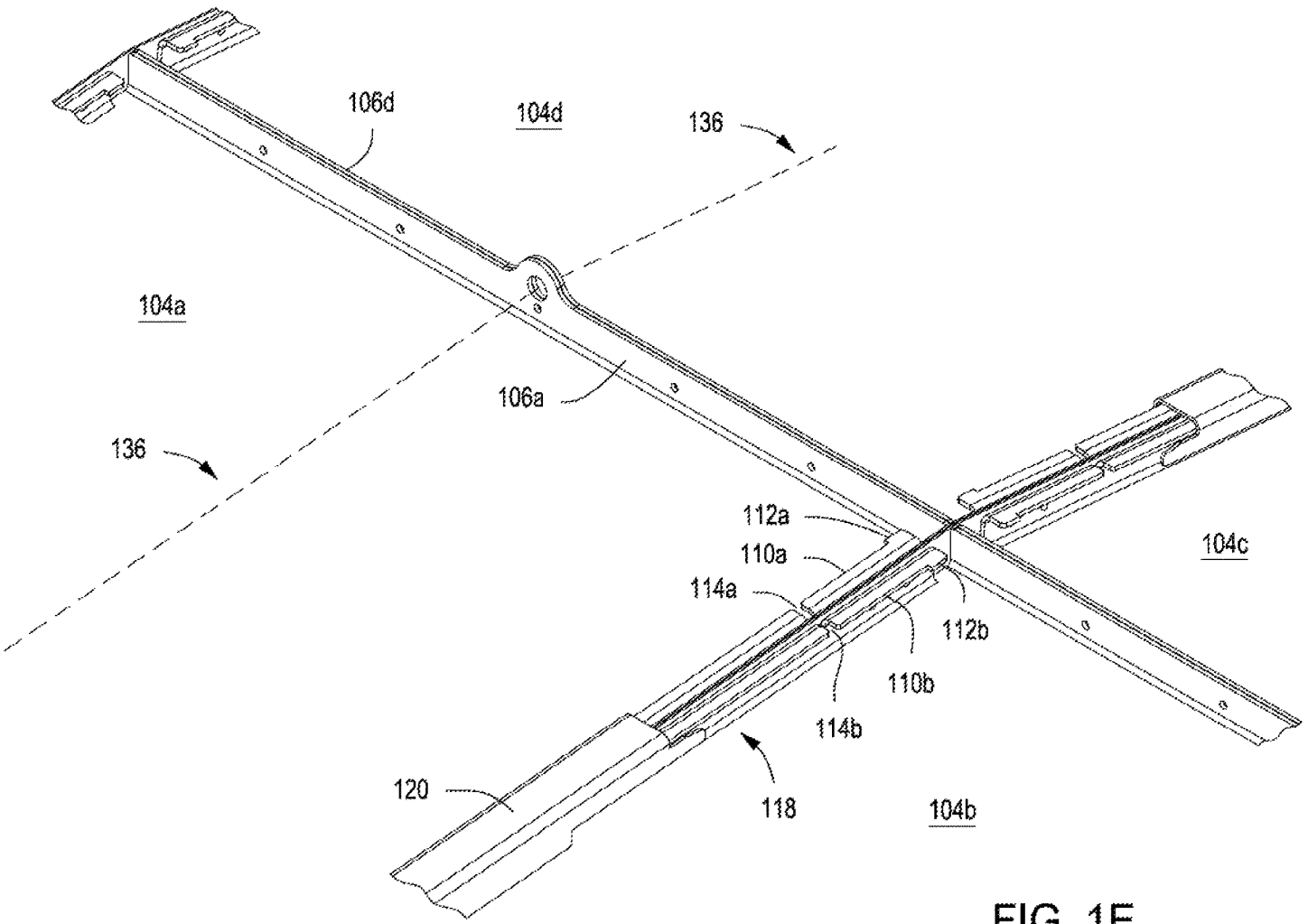
FIG. 1E shows a detailed view of four roof panels joined together, with rafters being partially covered by rafter covers.
Figure 1F:
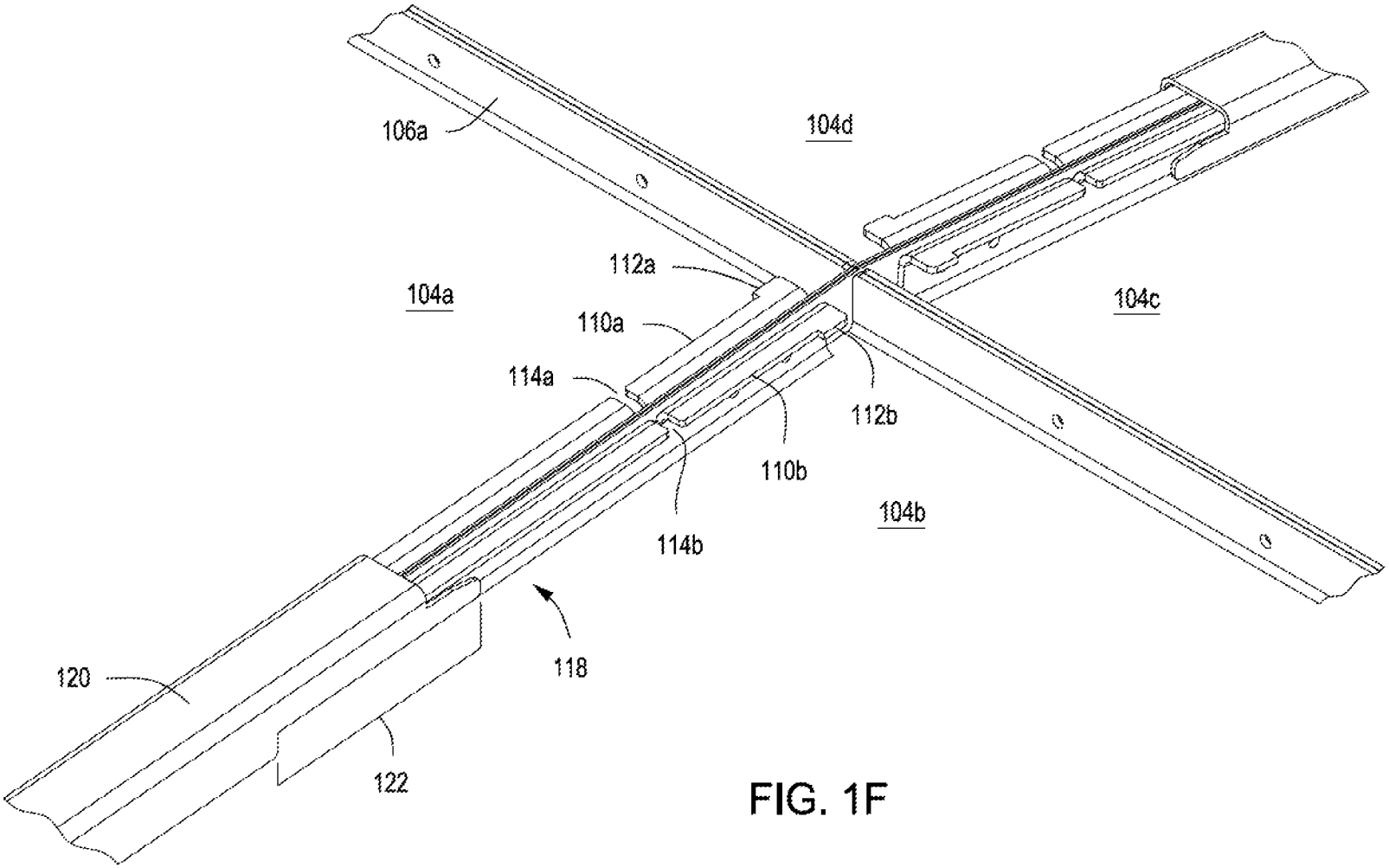
FIG. 1F shows a further detailed view of FIG. 1E.

The term "T-shaped groove" as used herein refers to an opening in or on a structure or surface of a structure having a profile similar to that of a block-letter capital T, as shown in FIG. 1B and FIG. 1D. A T-shaped groove may have a T-shape that has a narrow portion and a wide portion such that a line may laterally bisect the T-shape into two similar P-shaped halves (e.g., grooves). A T-shaped groove may be formed by combining two P-shaped grooves. A T-shaped groove may provide for a finger of a rafter cover to pass through the T-shaped groove.

3. Certain Specific Embodiments

Certain specific embodiments of methods, structures, elements, and parts are described below, which are by no means an exclusive description of the inventions. Other specific embodiments, including those referenced in the drawings, are encompassed by this application and any patent that issues therefrom.

The disclosure herein includes a method for assembling a roof including: covering a first portion of a roof ridge with a first ridge cap having a first groove disposed therein; covering a second portion of the roof ridge with a second ridge cap having a second groove disposed therein, wherein the first groove and the second groove may be combined to form a third groove; and sliding a rafter cover having a finger with a beveled edge along a rafter in the direction of the ridge caps, wherein the beveled edge may pass through the third groove.

The disclosure herein includes a method for assembling a roof including: covering a first portion of a roof ridge and a portion of a first flange with a first ridge cap having a first P-shaped groove disposed therein; covering a second portion of the roof ridge and a portion of a second flange with a second ridge cap having a second P-shaped groove disposed therein, wherein the first P-shaped groove may be combined with the second P-shaped groove to form a first T-shaped groove; and sliding a rafter cover having a finger with a beveled edge along the first flange and the second flange in the direction of the ridge cap, where in the beveled edge may pass through the first T-shaped groove.

The disclosure herein includes a method for assembling a roof including: providing a ridge cap assembly having a T-shaped groove; providing a rafter cover having a finger with a beveled edge; and sliding the rafter cover along a rafter in the direction of the ridge cap assembly, wherein the beveled edge may pass through the T-shaped groove.

The disclosure herein includes a roof assembly, including a ridge cap that may have a P-shape groove.

The disclosure herein includes a roof assembly, including a ridge cap cover that may have a T-shape groove.

The disclosure herein includes a roof assembly, including: a ridge cap that may have a P-shape groove; and a ridge cap cover that may have a T-shape groove.

The disclosure herein includes a roof assembly, including a roof panel that may have a flange having a tab extending therefrom.

The disclosure herein includes a roof assembly, including: a ridge cap that may have a P-shape groove; and a roof panel that may have a flange having a tab extending therefrom.

The disclosure herein includes a roof assembly, including: a ridge cap that may have a P-shape groove; a ridge cap cover that may have a T-shape groove; and a roof panel that may have a flange folded up from a side of the roof panel, the flange having a tab extending therefrom.

The disclosure herein includes a roof assembly, including a rafter cover that may have a finger extending from an end of the rafter cover.

The disclosure herein includes a roof assembly, including: a roof panel that may have a flange folded up from a side of the roof panel, the flange having a tab extending therefrom; and a rafter cover that may have a finger extending from an end of the rafter cover.

The disclosure herein includes a roof assembly, including: a ridge cap that may have a P-shape groove; and a rafter cover that may have a finger extending from an end of the rafter cover.

The disclosure herein includes a roof assembly, including: a ridge cap that may have a P-shape groove; a roof panel that may have a flange folded up from a side of the roof panel the flange having a tab extending therefrom; and a rafter cover that may have a finger extending from an end of the rafter cover.

The disclosure herein includes a roof assembly, including: a ridge cap that may have a P-shape groove; a ridge cap cover that may have a T-shape groove; and a rafter cover that may have a finger extending from an end of the rafter cover.

The disclosure herein includes a roof assembly, including: a ridge cap that may have a P-shape groove; a ridge cap cover that may have a T-shape groove; a roof panel that may have a flange folded up from a side of the roof panel, the flange having a tab extending therefrom and a rafter cover that may have a finger extending from an end of the rafter cover.

Any one of the methods, structures, elements or parts disclosed herein may further involve mounting a ridge cap cover over the first ridge cap and the second ridge cap, wherein the ridge cap cover has a fourth groove that may be aligned with the third groove.

Any one of the methods, structures, elements or parts disclosed herein may further involve sliding the rafter cover along the rafter such that the beveled edge may pass through the fourth groove.

Any one of the methods, structures, elements or parts disclosed herein may further involve sliding the beveled edge below tabs of the rafter.

In any one of the methods, structures, elements or parts disclosed herein, the rafter may be covered by the rafter cover.

In any one of the methods, structures, elements or parts disclosed herein, a first portion of the rafter cover and a first portion of the rafter may be covered by the first ridge cap and a second portion of the rafter cover and a second portion of the rafter may be covered by the second ridge cap.

Any one of the methods, structures, elements or parts disclosed herein may further involve sliding a portion of the first ridge cap through a first notch disposed in the rafter; and sliding a portion of the second ridge cap through a second notch disposed in the rafter.

Any one of the methods, structures, elements or parts disclosed herein may further involve mounting a ridge cap cover over the first ridge cap and the second ridge cap, wherein the ridge cap cover has a second T-shaped groove that may be aligned with the first T-shaped groove.

Any one of the methods, structures, elements or parts disclosed herein may further involve sliding a rafter cover along the first flange and the second flange such that the beveled edge may pass through the second T-shaped groove.

Any one of the methods, structures, elements or parts disclosed herein may further involve sliding the beveled edge below a first tab of the first flange and a second tab of the second flange.

In any one of the methods, structures, elements or parts disclosed herein, the first flange and the second flange may be covered by the rafter cover.

In any one of the methods, structures, elements or parts disclosed herein, a first portion of the rafter cover and a first portion of the rafter may be covered by the first ridge cap and a second portion of the rafter cover and a second portion of the rafter may covered by the second ridge cap.

Any one of the methods, structures, elements or parts disclosed herein may further involve sliding a portion of the first ridge cap through a first notch disposed in the first flange; and sliding a portion of the second ridge cap through a second notch disposed in the second flange.

Any one of the methods, structures, elements or parts disclosed herein may further involve providing a ridge cap assembly having a T-shaped groove; providing a rafter cover having a finger with a beveled edge; and sliding the rafter cover along a rafter in the direction of the ridge cap assembly, wherein the beveled edge may pass through the T-shaped groove.

Any one of the methods, structures, elements or parts disclosed herein may further involve sliding the beveled edge below tabs of the rafter.

In any one of the methods, structures, elements or parts disclosed herein, the rafter may be covered by the rafter cover.

In any one of the methods, structures, elements or parts disclosed herein, a portion of the rafter cover and a portion of the rafter may be covered by the ridge cap assembly.

Any one of the methods, structures, elements or parts disclosed herein may further involve sliding a portion of the ridge cap assembly through notches disposed in the rafter.

In any one of the methods, structures, elements or parts disclosed herein, the ridge cap cover may be capable of mounting the ridge cap.

In any one of the methods, structures, elements or parts disclosed herein, a profile of the P-shape groove may be capable of aligning with a profile portion of the T-shape groove.

In any one of the methods, structures, elements or parts disclosed herein, the ridge cap may by capable of covering the flange.

In any one of the methods, structures, elements or parts disclosed herein, a profile of the P-shape groove may be capable of aligning with a profile portion of the T-shape groove.

In any one of the methods, structures, elements or parts disclosed herein, the finger may be capable of sliding below the tab.

In any one of the methods, structures, elements or parts disclosed herein, the ridge cap may be capable of covering the finger.

In any one of the methods, structures, elements or parts disclosed herein, the ridge cap may be capable of covering both the finger and the flange.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific embodiments of the inventions shown in the drawings, which relate to roof structures, elements and parts that can be part of a roof, and methods for making roof assemblies. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

FIG. 1A shows an exploded view of a building structure, specifically a roof assembly 102, which includes four roof panels 104*a-d*, each having opposing long sides and opposing short sides. The terms "long side" and "short side" as used herein are relative terms, and refer to two different sides of a particular structure. When referring to the two sides, the long side is longer than the other side, which is the short side. Although four conjoined roof panels 104*a-d* are illustrated here to form a roof assembly 102, any number of roof panels 104 may be combined to form a roof assembly 102. Moreover, any number of roof assemblies 102 may by combined to form an even larger roof assembly 102.

As shown in FIG. 1A, each side of the roof panels 104*a-d* may have sides folded into integral components. The term "folded" as used herein refers to a portion of a larger structure having been bent to form a distinct unitary structure. For example, one short side may be folded up to form a roof ridge 106, and an opposing short side may be folded down to form an eave (see FIG. 4). In another example, each opposing long side of the roof panel 104 may be folded up to form a flange 110. The flange 110 may be folded, preferably twice at ninety (90) degrees each time, to create two bends to form a C-shape or D-shape, in which a line bisecting the convex portion of the C-shape or D-shape is aligned with a center line 136 of the roof panel 104 (see FIG. 3). From the second bend of each flange 110, at an end nearest the roof ridge 106, an integral tab 112 may extend farther towards the center line 136 of the roof panel 104 than the rest of flange 110. On an end of the flange 110 opposite the tab 112, a portion of the flange 110, defined by a notch 114, may extend along a substantial length of the corresponding long side of the roof panel 104.

Still referring to FIG. 1A, a roof panel 104 may join with another roof panel 104 along congruent roof ridges 106 or flanges 110. For example, the roof panels 104*a*, 104*b* may respectively join at the flanges 110*a*, 110*b* and the roof panels 104*b*, 104*c* may respectively join at the roof ridges 106*b*, 106*c*. Joining roof panels 104 at roof ridges 106 may form a compound roof ridge 108. For such a roof assembly, a gable 116 may be fastened (with rivets) to the outer long sides of the roof panels 104. On the other hand, joining the roof panels 104 at flanges 110 may form a rafter 118.

Where roof ridges 106 and flanges 110 join, seams are formed in-between. If left uncovered, the seams may suffer water leaks or other damage due to exposure. Thus, ridge caps 124*a*, 124*b* and rafter covers 120 may be included to cover the seams and prevent leaks. As shown in FIG. 1C, a ridge cap 124 may include opposing long sides folded down to form ridge cap lips 126. A P-shaped groove 128 forms at each end of the ridge cap lip 126.

Referring to FIG. 1F and FIG. 3, a rafter cover 120 may be folded, preferably twice at ninety (90) degrees each time, to create two bends to form a C-shape or D-shape. Furthermore, the rafter cover 120 includes a finger 122 that may be slid through the P-shaped groove 128 and pass under the ridge cap 124 and the tab 112. Shoulders 204, 206 define a distal phalanx of the finger 122. The distal phalanx has an upper beveled edge 202 to help the tip of the finger 122 clear possible obstructions (e.g. the tab 112, ridge cap 124, and ridge cap cover 130) while sliding towards the roof ridge 106.

Figure 2A:
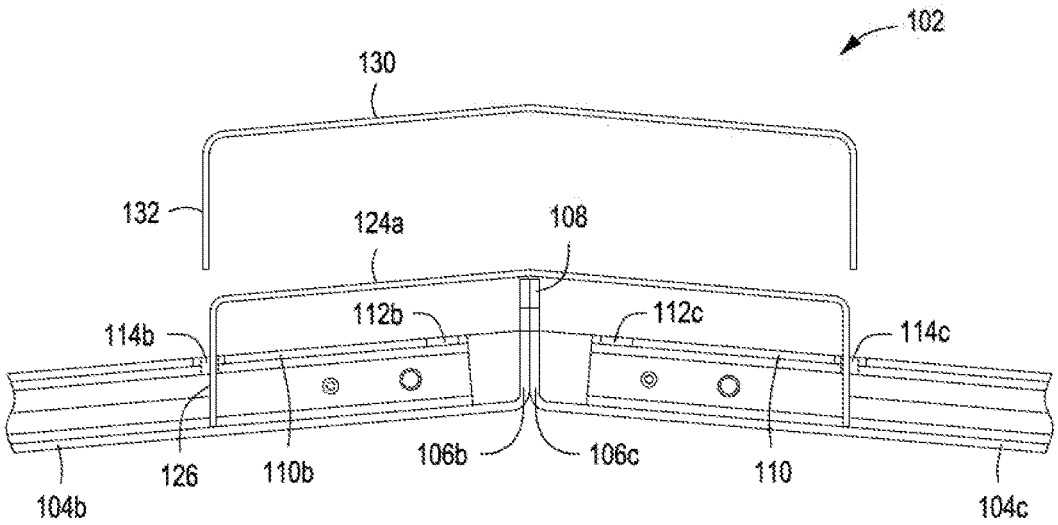
FIG. 2A shows a side view of a roof ridge being covered by a ridge cap.

At least one sequence of assembling certain components, e.g., joining the ridge caps 124 and the rafter covers 120 to cover seams in the roof assembly 102 of FIG. 1A is represented by side views A-C of FIG. 2 and FIG. 3. FIG. 2A shows a side view of the ridge cap 124*a* resting on connected roof panels 104*b*, 104*c*. The ridge cap 124*a* may straddle the roof panels 104*b*, 104*c* to cover the roof ridges 106*b*, 106*c*. The ends of the ridge cap lips 126 may be slid through the corresponding notches 114*b*, 114*b*', 114*c*, 114*c*', as shown by the dashed lines in FIG. 1A. Thus, on each roof panel 104, the ridge cap 124 may cover the roof ridge 106 and a portion of the flange 110 between the notch 114 and the roof ridge 106.

Figure 2B:
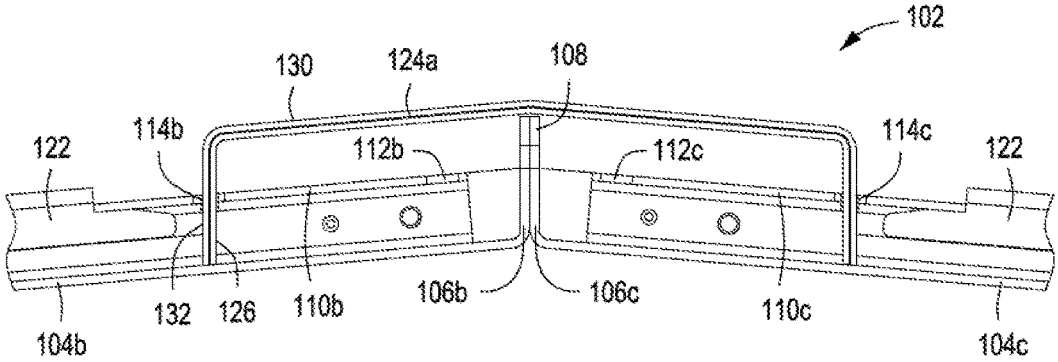
FIG. 2B shows a side view of a ridge cap being mounted by a ridge cap cover.

When two roof panels 104 are connected (coupled) so that they may be joined together at roof ridges 106, as described above, the ridge caps 124 are preferably connected as well. For example, as shown in FIG. 1A, when one joins the roof panels 104*a*, 104*d* with the roof panels 104*b*, 104*c* one preferably also joins the ridge caps 124*a*, 124*b*. P-shaped grooves 128*a*, 128*b* of the connected ridge caps 124 may be combined to form a T-shaped groove, as shown in FIG. 1D. However, such connection may create an additional seam that may be susceptible to water leakage. Thus, as illustrated in FIG. 1A and FIG. 2B, a ridge cap cover 130 may be included for mounting the ridge caps 124*a*, 124*b* and cover the seam. The ridge cap cover 130 may include short sides folded down into ridge cap cover lips 132. Each ridge cap cover lip 132 may have a T-shaped groove 134. When the ridge cap cover 130 is unmounted on the ridge caps 124*a*, 124*b*, the T-shaped groove 134 can be aligned with the T-shaped groove formed by the P-shaped grooves 128*a*, 128*b*. The T-shaped groove 134 and the P-shaped grooves 124*a*, 124*b* may provide for the finger 122 of the rafter cover 120 to pass through and under the ridge cap cover 130 and ridge caps 124.

FIGS. 2B-C show a side-view sequence for sliding the rafter cover 120 over the flange 110*b*. Although flange 110*a* is not shown in FIG. 2, it is understood that the rafter cover 120 may also be slid over flange 110*a* given that the roof panels 104*a*, 104*b* may be connected at the flanges 110*a*, 110*b*, as shown in FIG. 1F. After setting the ridge caps 124 and the ridge cap cover 130, one may slide the rafter cover 120 forward along the length of the flanges 110*a*, 110*b* with the finger 122 pointing towards the roof ridges 106*b*, 106*c*. During assembly, as the rafter cover 120 continues to be slid forward, the finger 122 may pass through the ridge cap 124 and ridge cap cover 130, specifically through the T-shaped groove 134 (not shown) of the ridge cap cover 130 and the P-shaped groove 128 of the ridge cap 124 (not shown). Once the shoulder 204 of the finger 122 abuts the tab 112, the tab 112 may prevent the rafter cover 120 from traveling further.

Figure 4:
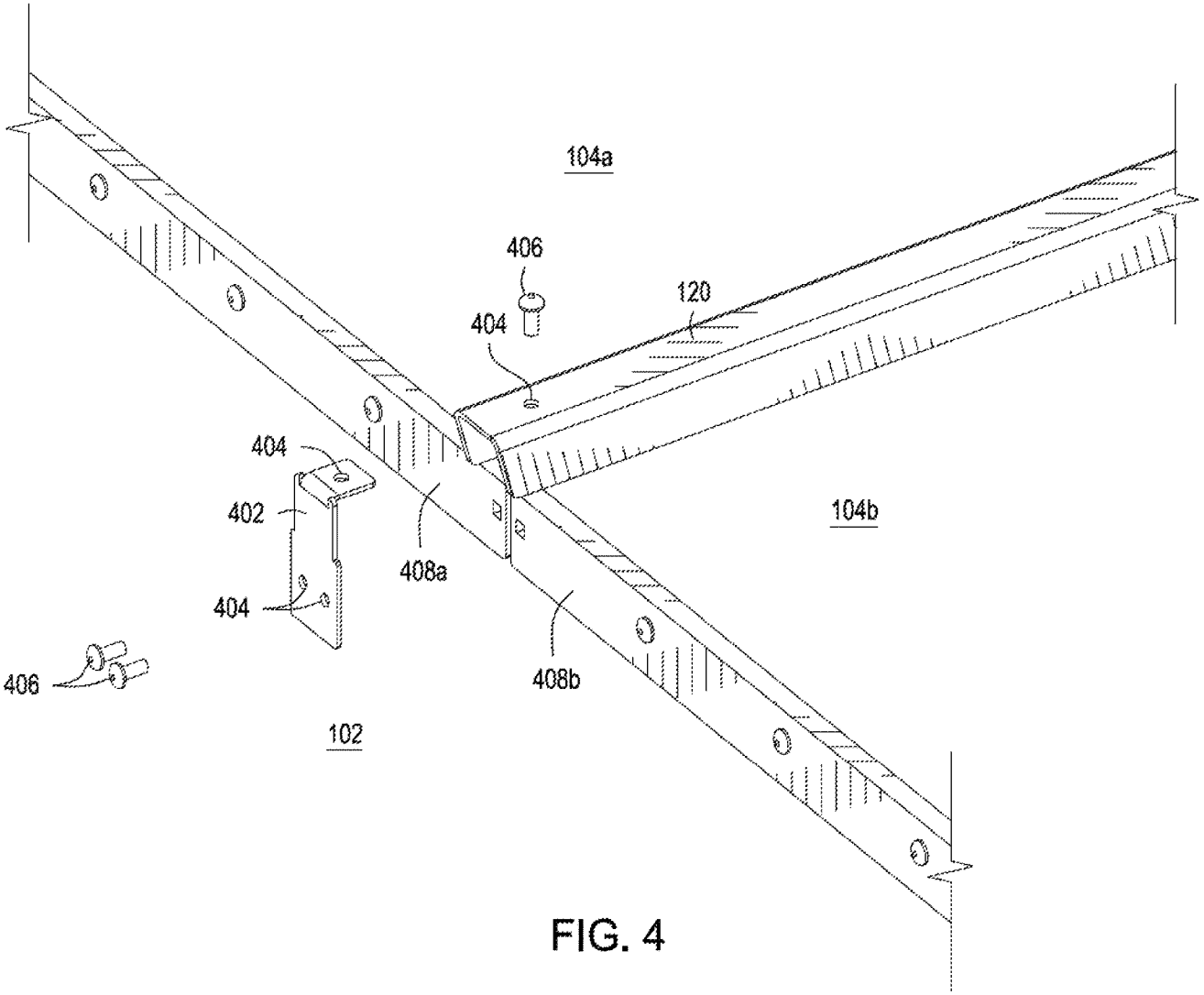
FIG. 4 shows an exploded view of a fastener for a rafter cover to the roof assembly of FIG. 1A.

Referring to the exploded view of FIG. 4, a fastener 402 may be coupled, via rivet holes 404 and rivets 406, to the rafter cover 120 and eaves 408*a*, 408*b* to prevent the rafter cover 120 from sliding back and out of the ridge caps 124.

What is claimed as the invention is:

1. A method for assembling a roof comprising:

covering a first portion of a roof ridge with a first ridge cap having a first groove disposed therein;

covering a second portion of the roof ridge with a second ridge cap having a second groove disposed therein, wherein the first groove and the second groove are combined to form a third groove; and sliding a rafter cover having a finger with a beveled edge along a rafter in the direction of the ridge caps, wherein the beveled edge passes through the third groove further comprising mounting a ridge cap cover over the first ridge cap and the second ridge cap, wherein the ridge cap cover has a fourth groove that is aligned with the third groove.

2. The method of claim 1 further comprising sliding the rafter cover along the rafter such that the beveled edge passes through the fourth groove.

3. The method of claim 1 further comprising sliding the beveled edge below tabs of the rafter.

4. The method of claim 1, wherein the rafter is covered by the rafter cover.

5. The method of claim 1, wherein a first portion of the rafter cover and a first portion of the rafter are covered by the first ridge cap and a second portion of the rafter cover and a second portion of the rafter are covered by the second ridge cap.

6. The method of claim 1 further comprising:

sliding a portion of the first ridge cap through a first notch disposed in the rafter, and sliding a portion of the second ridge cap through a second notch disposed in the rafter.

7. A method for assembling a roof comprising:

covering a first portion of a roof ridge and a portion of a first flange with a first ridge cap having a first P-shaped groove disposed therein;

covering a second portion of the roof ridge and a portion of a second flange with a second ridge cap having a second P-shaped groove disposed therein, wherein the first P-shaped groove is combined with the second P-shaped groove to form a first T-shaped groove; and sliding a rafter cover having a finger with a beveled edge along the first flange and the second flange in the direction of the ridge cap, where in the beveled edge passes through the first T-shaped groove.

8. The method of claim 7 further comprising mounting a ridge cap cover over the first ridge cap and the second ridge cap, wherein the ridge cap cover has a second T-shaped groove that is aligned with the first T-shaped groove.

9. The method of claim 8 further comprising sliding a rafter cover along the first flange and the second flange such that the beveled edge passes through the second T-shaped groove.

10. The method of claim 7 further comprising sliding the beveled edge below a first tab of the first flange and a second tab of the second flange.

11. The method of claim 7, wherein the first flange and the second flange are covered by the rafter cover.

12. The method of claim 7, wherein a first portion of the rafter cover and a first portion of the rafter are covered by the first ridge cap and a second portion of the rafter cover and a second portion of the rafter are covered by the second ridge cap.

13. The method of claim 7 further comprising:

sliding a portion of the first ridge cap through a first notch disposed in the first flange; and sliding a portion of the second ridge cap through a second notch disposed in the second flange.

14. A method for assembling a roof comprising:

providing a ridge cap assembly having a T-shaped groove;

providing a rafter cover having a finger with a beveled edge; and sliding the rafter cover along a rafter in the direction of the ridge cap assembly, wherein the beveled edge passes through the T-shaped groove further comprising sliding a portion of the ridge cap assembly through notches disposed in flanges of the rafter.

15. The method of claim 14 further comprising sliding the beveled edge below the flanges of the rafter.

16. The method of claim 14, wherein the rafter is covered by the rafter cover.

17. The method of claim 14, wherein a portion of the rafter cover and a portion of the rafter are covered by the ridge cap assembly.

* * * * *